US009291985B2

(12) United States Patent
Nakamura et al.

(10) Patent No.: US 9,291,985 B2
(45) Date of Patent: Mar. 22, 2016

(54) CLEANING BLADE, PROCESS CARTRIDGE, AND IMAGE FORMING APPARATUS

(71) Applicant: FUJI XEROX CO., LTD., Minato-ku, Tokyo (JP)

(72) Inventors: Yu Nakamura, Kanagawa (JP); Daisuke Tano, Kanagawa (JP); Masato Ono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/482,608

(22) Filed: Sep. 10, 2014

(65) Prior Publication Data

US 2015/0261170 A1 Sep. 17, 2015

(30) Foreign Application Priority Data

Mar. 11, 2014 (JP) ..... 2014-048141

(51) Int. Cl.
*G03G 21/00* (2006.01)

(52) U.S. Cl.
CPC ..... *G03G 21/0017* (2013.01); *G03G 21/0011* (2013.01); *G03G 2215/0132* (2013.01)

(58) Field of Classification Search
USPC ..... 399/350
See application file for complete search history.

(56) References Cited

U.S. PATENT DOCUMENTS 8,787,813 B2 * 7/2014 Tano ..... G03G 21/0017 399/350

FOREIGN PATENT DOCUMENTS

JP 2004-281277 A 10/2004

* cited by examiner

*Primary Examiner* — Minh Phan
(74) *Attorney, Agent, or Firm* — Sughrue Mion, PLLC

(57) ABSTRACT

A cleaning blade includes a member in which, in thermal analysis with a differential scanning calorimeter, a heat of crystal fusion ΔH1 (mJ/mg) in a crystal fusion peak 1 in a range of about 70° C. or higher and lower than about 110° C., a heat of crystal fusion ΔH2 (mJ/mg) in a crystal fusion peak 2 in a range of about 110° C. or higher and lower than about 170° C., and a heat of crystal fusion ΔH3 (mJ/mg) in a crystal fusion peak 3 in a range of about 170° C. or higher and about 200° C. or lower satisfy formulae (1) to (4), the member constituting at least a contact portion that comes in contact with a member to be cleaned.

$\Delta H1+\Delta H2>\Delta H3$ Formula (1)

$0.0\leq\Delta H1\leq5.0$ Formula (2)

$0.1\leq\Delta H2$ Formula (3)

$0.0\leq\Delta H3\leq2.0$ Formula (4)

11 Claims, 6 Drawing Sheets

CLEANING BLADE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-048141 filed Mar. 11, 2014.

BACKGROUND (i) Technical Field

The present invention relates to a cleaning blade, a process cartridge, and an image forming apparatus.

(ii) Related Art

Hitherto, in copying machines, printers, facsimiles, etc. using an electrophotographic system, a cleaning blade has been used as a cleaning device for removing a remaining toner and the like on a surface of an image carrying member such as a photoreceptor.

SUMMARY

According to an aspect of the invention, there is provided a cleaning blade including a member in which, in thermal analysis with a differential scanning calorimeter, a heat of crystal fusion ΔH1 (mJ/mg) in a crystal fusion peak 1 in a range of about 70° C. or higher and lower than about 110° C., a heat of crystal fusion ΔH2 (mJ/mg) in a crystal fusion peak 2 in a range of about 110° C. or higher and lower than about 170° C., and a heat of crystal fusion ΔH3 (mJ/mg) in a crystal fusion peak 3 in a range of about 170° C. or higher and about 200° C. or lower satisfy formulae (1) to (4), the member constituting at least a contact portion that comes in contact with a member to be cleaned.

$$\Delta H1+\Delta H2>\Delta H3 \quad \text{Formula (1)}$$

$$0.0\leq\Delta H1\leq5.0 \quad \text{Formula (2)}$$

$$0.1\leq\Delta H2 \quad \text{Formula (3)}$$

$$0.0\leq\Delta H3\leq2.0 \quad \text{Formula (4)}$$

BRIEF DESCRIPTION OF THE DRAWINGS

Exemplary embodiments of the present invention will be described in detail based on the following figures, wherein.

DETAILED DESCRIPTION

Figure 1:
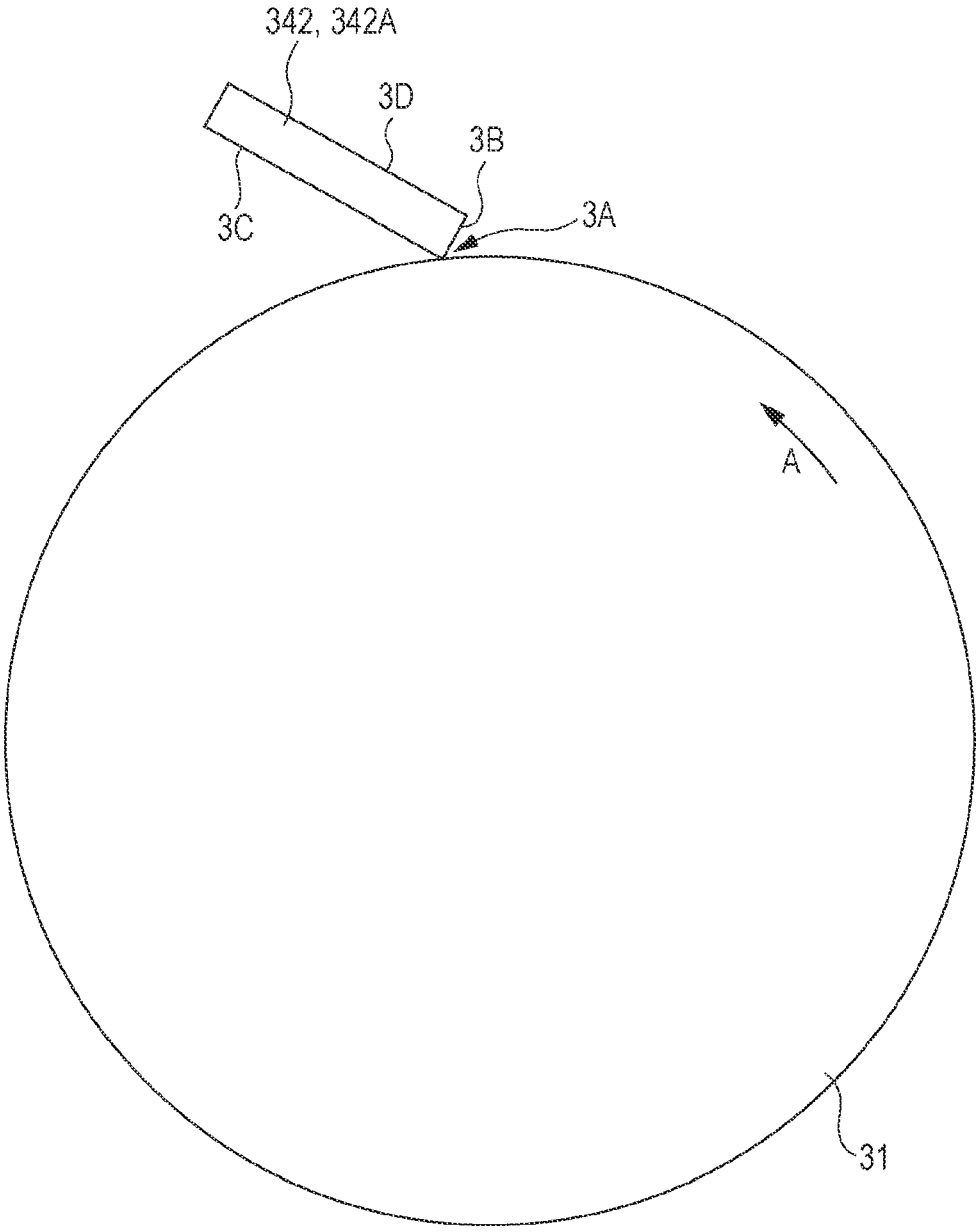
FIG. 1 is a schematic view illustrating an example of a cleaning blade according to an exemplary embodiment.

A cleaning blade, a cleaning device, a process cartridge, and an image forming apparatus according to exemplary embodiments of the invention will be described in detail.

<Cleaning Blade>

A cleaning blade according to an exemplary embodiment includes a member in which, in thermal analysis with a differential scanning calorimeter, a heat of crystal fusion ΔH1 (mJ/mg) in a crystal fusion peak 1 in the range of 70° C. or higher and lower than 110° C. or in the range of about 70° C. or higher and lower than about 110° C., a heat of crystal fusion ΔH2 (mJ/mg) in a crystal fusion peak 2 in the range of 110° C. or higher and lower than 170° C. or in the range of about 110° C. or higher and lower than about 170° C., and a heat of crystal fusion ΔH3 (mJ/mg) in a crystal fusion peak 3 in the range of 170° C. or higher and 200° C. or lower or in the range of about 170° C. or higher and about 200° C. or lower satisfy formulae (1) to (4) described below, the member constituting at least a contact portion that comes in contact with a member to be cleaned.

$$\Delta H1+\Delta H2>\Delta H3 \quad \text{Formula (1)}$$

$$0.0\leq\Delta H1\leq5.0 \quad \text{Formula (2)}$$

$$0.1\leq\Delta H2 \quad \text{Formula (3)}$$

$$0.0\leq\Delta H3\leq2.0 \quad \text{Formula (4)}$$

Hitherto, good abrasion resistance has been desired for a cleaning blade from the viewpoint of the realization of a long lifetime of the cleaning blade. In addition, when a local stress is applied to a portion of a cleaning blade that comes in contact with a member to be cleaned, a partial chipping of the cleaning blade may occur and cleaning is not performed at the position where the chipping has occurred. Thus, chipping resistance against a local stress has also been desired.

In general, regarding a cleaning blade formed of an elastic member, when molecular mobility of the elastic member is increased, low-temperature properties of the elastic member are improved and the glass transition temperature decreases, and thus a sufficient chipping resistance is provided. However, by increasing the molecular mobility, the hardness of the elastic member is decreased and abrasion resistance decreases. That is, it is difficult to realize both high chipping resistance and high abrasion resistance at the same time.

In contrast, in the cleaning blade according to the present exemplary embodiment, at least a portion that comes in contact with a member to be cleaned is formed of a member that satisfies formulae (1) to (4) above. Therefore, both high chipping resistance and high abrasion resistance are realized.

The reason for this is believed to be as follows, though the reason is not necessarily clear.

Specifically, the elastic member of the cleaning blade has a molecular structure including a hard segment and a soft segment. The two segments form a sea-island structure in which domains of the hard segment are dispersed in the soft segment. The hard segment, which is harder, contributes to the hardness. That is, the hard segment contributes to abrasion resistance. On the other hand, the soft segment, which is softer, contributes to molecular mobility. That is, the soft segment contributes to chipping resistance.

However, when the diameter of the hard-segment domains is small and the hard-segment domains are excessively dispersed, the distance of the soft segment that is present between hard-segment domains becomes relatively short. Consequently, the molecular mobility due to the soft segment is inhibited by the hard segment, and chipping resistance decreases.

In contrast, in the case where the hard segment is moderately agglomerated and the number of hard-segment domains is decreased without decreasing the total amount of the hard segment, the distance of the soft segment that is present between hard-segment domains becomes relatively long. Consequently, the inhibition of the molecular mobility of the soft segment, the inhibition being caused by the hard segment, is reduced, and chipping resistance improves. Since the total amount of the hard segment is not decreased, the hardness of the elastic member does not change. That is, abrasion resistance is satisfactorily maintained.

However, when the hard segment is excessively agglomerated, the size of the agglomerate of the hard segment becomes excessively large, and the total surface area of the hard segment decreases. Consequently, chipping easily occurs at an interface between the hard segment and the soft segment.

It is believed that the heat of crystal fusion ΔH1 (mJ/mg), the heat of crystal fusion ΔH2 (mJ/mg), and the heat of crystal fusion ΔH3 (mJ/mg) that are specified in the present exemplary embodiment represent the following. The heat of crystal fusion ΔH1 (mJ/mg) in the crystal fusion peak 1 in the range of 70° C. or higher and lower than 110° C. or in the range of about 70° C. or higher and lower than about 110° C. represents the elastic material in which the diameter of the hard-segment domains is small and the hard-segment domains are excessively dispersed. The heat of crystal fusion ΔH2 (mJ/mg) in the crystal fusion peak 2 in the range of 110° C. or higher and lower than 170° C. or in the range of about 110° C. or higher and lower than about 170° C. represents the elastic material in which the hard segment is moderately agglomerated. The heat of crystal fusion ΔH3 (mJ/mg) in the crystal fusion peak 3 in the range of 170° C. or higher and 200° C. or lower or in the range of about 170° C. or higher and about 200° C. or lower represents the elastic material in which the hard segment is excessively agglomerated.

Specifically, in the cleaning blade according to the present exemplary embodiment, the heat of crystal fusion ΔH1 is controlled to 5.0 or less, thus suppressing the ratio of the elastic material in which the diameter of the hard-segment domains is small and the hard-segment domains are excessively dispersed. The heat of crystal fusion ΔH3 is controlled to 2.0 or less and the heat of crystal fusion ΔH3 is controlled to be less than the total amount of ΔH1 and ΔH2, thus suppressing the ratio of the elastic material in which the hard segment is excessively agglomerated. Furthermore, the heat of crystal fusion ΔH2 is controlled to 0.1 or more. Thus, the ratio of the elastic material in which the hard segment is moderately agglomerated is controlled to a certain value or more. When the ΔH1, the ΔH2, and the ΔH3 satisfy the above conditions, chipping resistance is improved while good abrasion resistance is maintained.

Heat of Crystal Fusion ΔH1, Heat of Crystal Fusion ΔH2, and Heat of Crystal Fusion ΔH3

The heat of crystal fusion ΔH1 (mJ/mg) in the crystal fusion peak 1 in the range of 70° C. or higher and lower than 110° C. or in the range of about 70° C. or higher and lower than about 110° C. is in the range of "0.0≤ΔH1≤5.0" as described in formula (2) above, more preferably in the range of "0.0≤ΔH1≤3.0", and still more preferably in the range of "1.0≤ΔH1≤3.0".

When the heat of crystal fusion ΔH1 exceeds 5.0, chipping resistance is decreased.

The heat of crystal fusion ΔH2 (mJ/mg) in the crystal fusion peak 2 in the range of 110° C. or higher and lower than 170° C. or in the range of about 110° C. or higher and lower than about 170° C. is in the range of "0.1≤ΔH2" as described in formula (3) above, more preferably in the range of "2.0≤ΔH2≤5.0", and still more preferably in the range of "3.0≤ΔH2≤5.0".

When the heat of crystal fusion ΔH2 is less than 0.1, chipping resistance is decreased.

The heat of crystal fusion ΔH3 (mJ/mg) in the crystal fusion peak 3 in the range of 170° C. or higher and 200° C. or lower or in the range of about 170° C. or higher and about 200° C. or lower is in the range of "0.0≤ΔH3≤2.0" as described in formula (4) above, more preferably in the range of "0.0≤ΔH3≤1.0", and still more preferably in the range of "0.0≤ΔH3≤0.5".

When the heat of crystal fusion ΔH3 exceeds 2.0, chipping resistance is decreased.

The heat of crystal fusion ΔH1 in the crystal fusion peak 1, the heat of crystal fusion ΔH2 in the crystal fusion peak 2, and the heat of crystal fusion ΔH3 in the crystal fusion peak 3 are measured by differential scanning calorimetry (DSC) in accordance with ASTM D3418-99.

A Diamond-differential scanning calorimeter (DSC) manufactured by PerkinElmer Inc. is used in the measurement. The temperature in a detection unit of the measurement apparatus is corrected by using the melting temperatures of indium and zinc. The quantity of heat is corrected by using the heat of fusion of indium. In the measurement, an aluminum pan is used for a measurement sample and an empty pan is set as a control.

The heat of crystal fusion ΔH1, the heat of crystal fusion ΔH2, and the heat of crystal fusion ΔH3 may be controlled so as to satisfy formulae (1) to (4) by adjusting the degree of agglomeration of the hard segment in an elastic material of a member constituting the contact portion of the cleaning blade. The specific method for controlling the ΔH1, ΔH2, and ΔH3 is not particularly limited. For example, a post-heating step may be performed after the member constituting the contact portion of the cleaning blade is formed as an elastic member. The hard segment is agglomerated by conducting heating. In addition, the degree of agglomeration is suitably controlled by controlling the degree of heating, namely, the temperature, the time, etc. of the heating.

The structure of a cleaning blade according to the present exemplary embodiment will now be described in detail.

Figure 2:
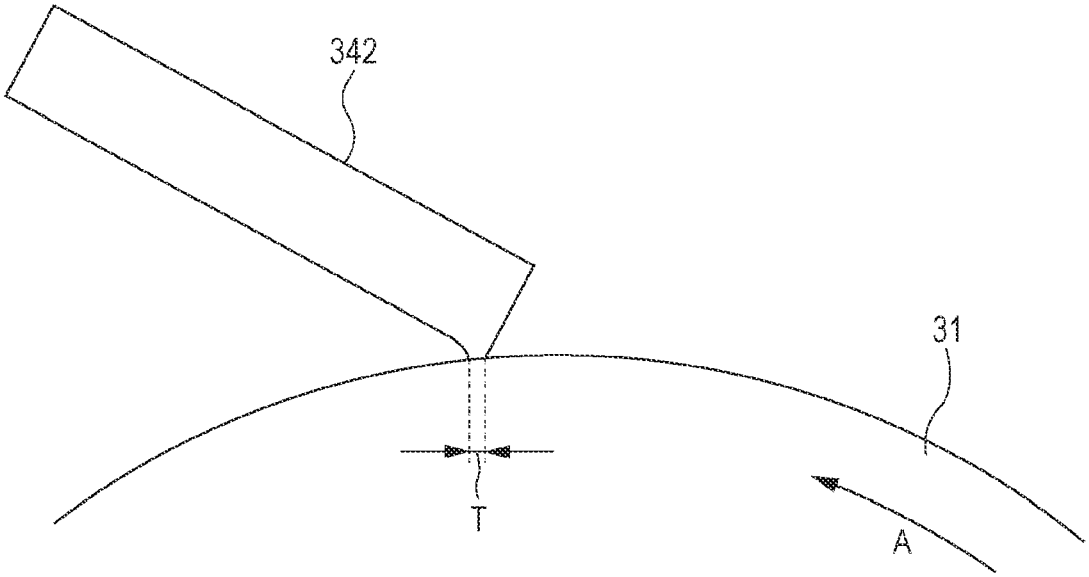
FIG. 2 is a schematic view illustrating a state in which a cleaning blade according to an exemplary embodiment is in contact with an image carrying member which is driving.

The cleaning blade according to the exemplary embodiment is arranged to be in contact with a surface of a member 31 to be cleaned, as illustrated in FIG. 1. When the member 31 to be cleaned is driven, as illustrated in FIG. 2, sliding occurs in a contact portion where a cleaning blade 342 is in contact with the member 31 to be cleaned, and a nip part T is formed. Thus, the surface of the member 31 to be cleaned is cleaned.

Respective portions of the cleaning blade will now be described with reference to the drawings. In the description below, as illustrated in FIG. 1, the cleaning blade includes a contact angle portion 3A, an end surface 3B, a front surface 3C, and a back surface 3D. The contact angle portion 3A comes in contact with the member (image carrying member, i.e., photoreceptor drum) 31 that is driven and that is to be cleaned, and cleans the surface of the member (image carrying member) 31 to be cleaned. The end surface 3B, one edge of which is formed by the contact angle portion 3A, faces the upstream of a direction in which the member 31 is driven (direction shown by the arrow A). The front surface 3C, one edge of which is formed by the contact angle portion 3A, faces the downstream of the direction in which the member 31 is driven (direction shown by the arrow A). The back surface 3D, one edge of which is shared with the end surface 3B, faces the front surface 3C.

A direction parallel to a direction in which the contact angle portion 3A comes in contact with the member 31 to be cleaned (direction from the front surface to the back surface of the paper of FIG. 1) is referred to as a "longitudinal direction". A direction extending from the contact angle portion 3A to the side on which the end surface 3B is formed is referred to as a "thickness direction". A direction extending from the contact angle portion 3A to the side on which the front surface 3C is formed is referred to as a "width direction".

In FIG. 1, for the sake of convenience, the direction in which the image carrying member (photoreceptor drum) 31 is driven is shown by the arrow A. However, FIG. 1 illustrates a state where the image carrying member 31 is stopped.

Figure 5:
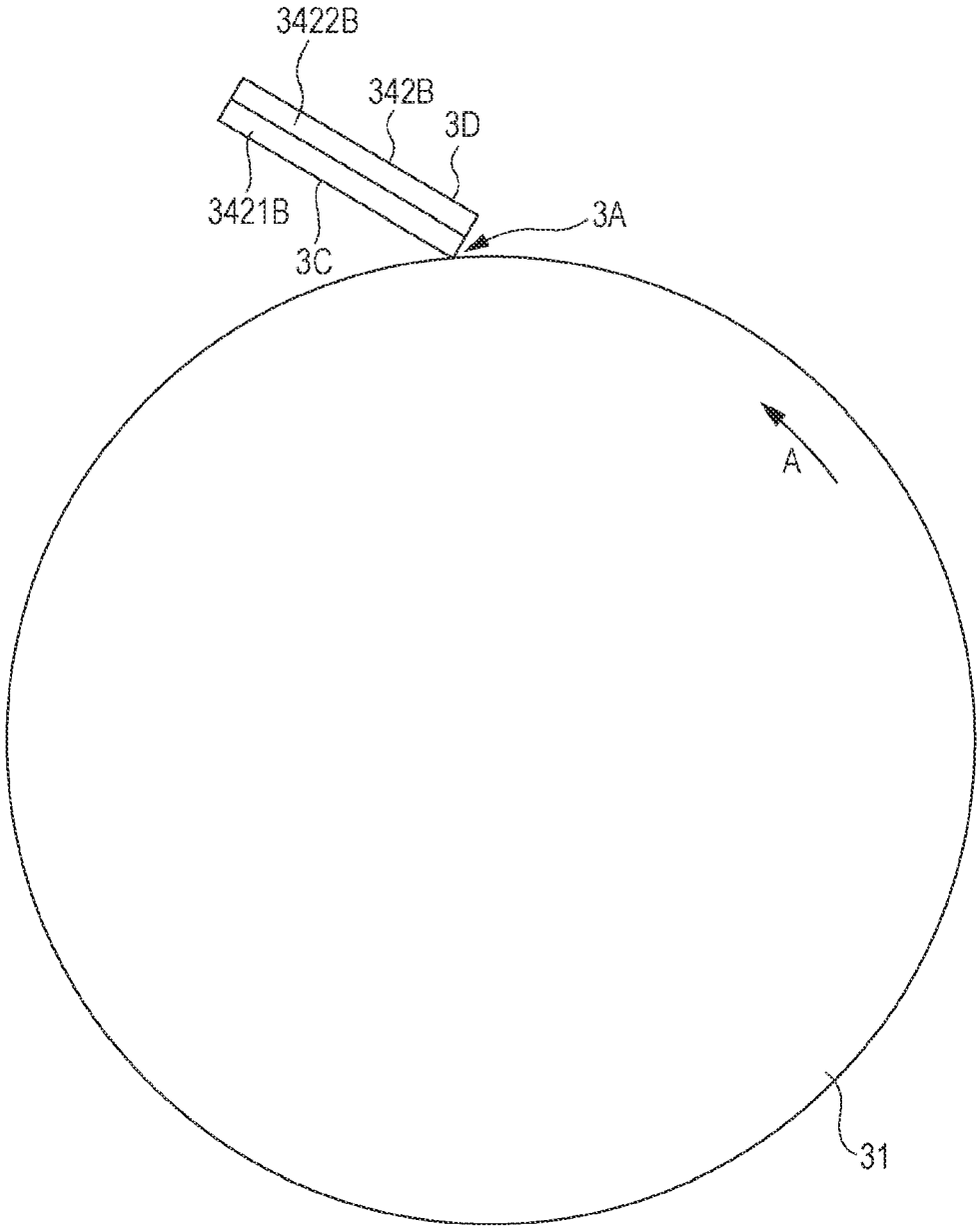
FIG. 5 is a schematic view illustrating another example of a cleaning blade according to an exemplary embodiment.
Figure 6:
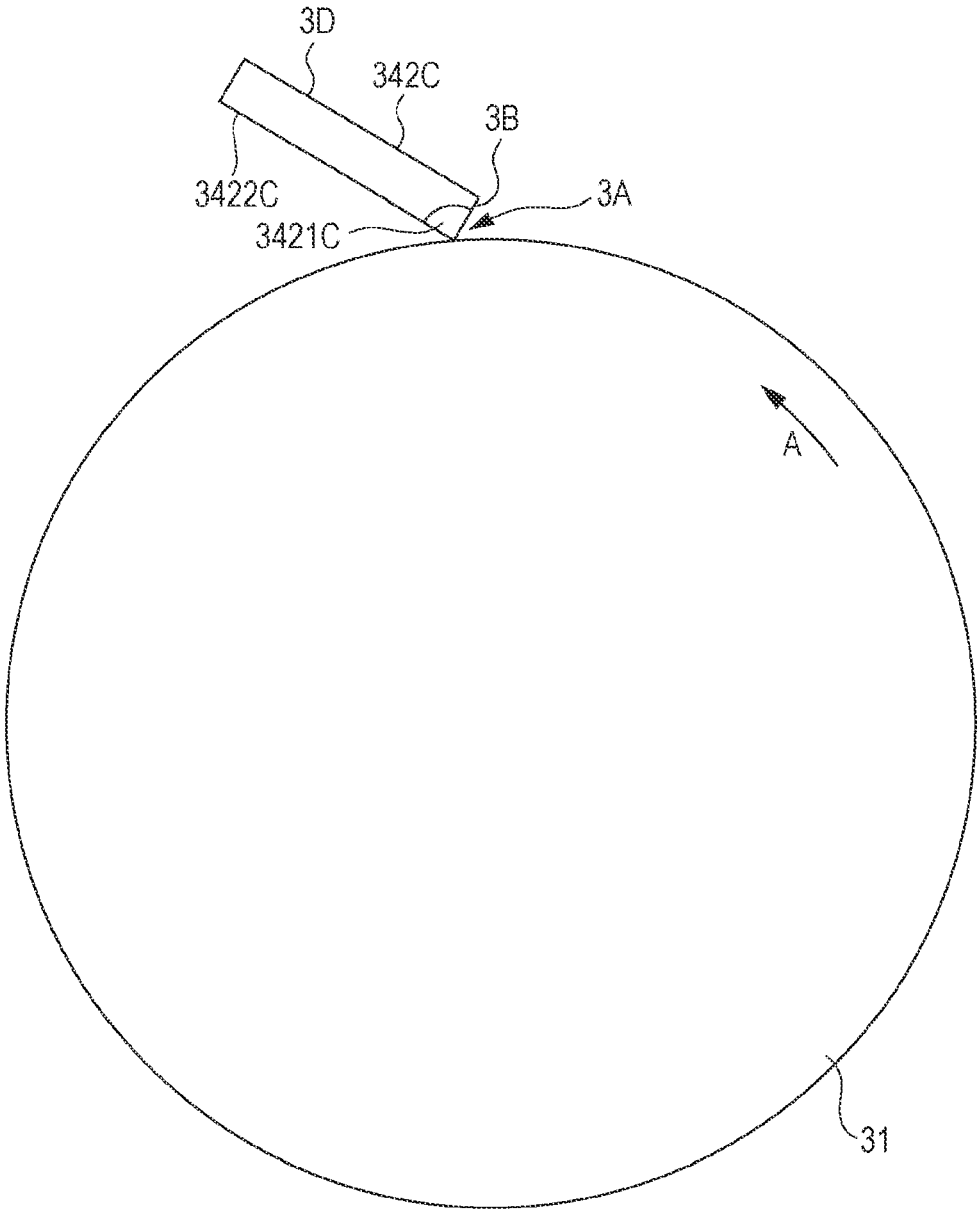
FIG. 6 is a schematic view illustrating another example of a cleaning blade according to an exemplary embodiment.

FIG. 1 is a schematic view illustrating a cleaning blade according to a first exemplary embodiment, and illustrates a state where the cleaning blade is in contact with a surface of a photoreceptor drum, which is an example of a member to be cleaned. FIG. 5 is a schematic view illustrating a state where a cleaning blade according to a second exemplary embodiment is in contact with a surface of a photoreceptor drum. FIG. 6 is a schematic view illustrating a state where a cleaning blade according to a third exemplary embodiment is in contact with a surface of a photoreceptor drum.

A cleaning blade 342A according to the first exemplary embodiment illustrated in FIG. 1 includes only a contact member. Specifically, the whole of the cleaning blade 342A including a portion (contact angle portion 3A) that comes in to contact with a photoreceptor drum 31 is composed of a single material.

The cleaning blade according to the exemplary embodiment may have a two-layer structure as in the second exemplary embodiment illustrated in FIG. 5. Specifically, the cleaning blade may include a first layer 3421B and a second layer 3422B. The first layer 3421B includes a portion (contact angle portion 3A) which comes in contact with the photoreceptor drum 31, is formed over the entire surface on the front surface 3C side, and functions as a contact member. The second layer 3422B is formed on the back surface 3D side relative to the first layer 3421B, and functions as a back surface layer composed of a material different from that of the contact member.

The cleaning blade of the exemplary embodiment may have a structure as in the third exemplary embodiment illustrated in FIG. 6. Specifically, the cleaning blade and may include a contact member (edge member) 3421C and a back surface member 3422C. The contact member 3421C includes a portion (i.e., contact angle portion 3A) which comes in contact with the photoreceptor drum 31. The contact member 3421C has a shape in which a quarter-circle column extends in the longitudinal direction, and a right-angle portion of the shape forms the contact angle portion 3A of the contact member. The back surface member 3422C covers a portion on the back surface 3D side of the contact member 3421C in the thickness direction and a portion on the side opposite to the end surface 3B of the contact member 3421C in the width direction. That is, the back surface member 3422C constitutes a portion other than the contact member 3421C. The back surface member 3422C is composed of a material different from that of the contact member 3421C.

FIG. 6 illustrates, as the contact member, an example of a member having a shape of a quarter-circle column. However, the shape of the contact member is not limited thereto. Alternatively, the contact member may have a shape of a quarter-ellipse column, a square-cross-section quadrangular prism, a rectangular-cross-section quadrangular prism, or the like.

(Contact Member)

The contact member in the cleaning blade according to the present exemplary embodiment is constituted by a member in which the heat of crystal fusion ΔH1, the heat of crystal fusion ΔH2, and the heat of crystal fusion ΔH3 satisfy formulae (1) to (4) above.

The contact member may be constituted by an elastic member and may contain a resin.

—Resin—

The contact member of the cleaning blade according to the present exemplary embodiment is not particularly limited, and may contain a resin. Examples of the resin include polyurethane rubber, silicone rubber, fluororubber, propylene rubber, and butadiene rubber. In particular, polyurethane rubber is preferable. Highly crystallized polyurethane rubber is more preferable.

Polyurethane rubber is usually synthesized by polymerizing a polyisocyanate and a polyol. Besides a polyol, a resin having a functional group that may react with an isocyanate group may be used. The polyurethane rubber may have a hard segment and a soft segment.

Herein, the term "hard segment" refers to a segment composed of a material harder than a material of the soft segment in a resin, and the term "soft segment" refers to a segment composed of a material softer than a material of the hard segment in the resin.

The combination of the material constituting the hard segment (hard segment material) and the material constituting the soft segment (soft segment material) is not particularly limited. The hard segment material and the soft segment material may be selected from known resin materials so that a first material that is harder than a second material and the second material that is softer than the first material are used in combination. In the present exemplary embodiment, combinations described below are suitable.

Soft Segment Material

Examples of the soft segment material include polyols such as polyester polyols obtained by dehydration and condensation of a diol and a dibasic acid, polycarbonate polyols obtained by a reaction between a diol and an alkyl carbonate, polycaprolactone polyols, and polyether polyols. Examples of commercially available products of the above polyols used as the soft segment material include PLACCEL 205 and PLACCEL 240 manufactured by Daicel Corporation.

Hard Segment Material

A resin having a functional group that may react with an isocyanate group may be used as the hard segment material. The hard segment material is preferably a resin having flexibility. From the viewpoint of flexibility, the hard segment material is more preferably an aliphatic resin having a straight-chain structure. Specific examples of the resin include acrylic resins having two or more hydroxyl groups, polybutadiene resins having two or more hydroxyl groups, and epoxy resins having two or more epoxy groups.

Examples of commercially available products of the acrylic resins having two or more hydroxyl groups include ACTFLOW (grade: UMB-2005B, UMB-2005P, UMB-2005, UME-2005, etc.) manufactured by Soken Chemical & Engineering Co., Ltd.

An example of commercially available products of the polybutadiene resins having two or more hydroxyl groups is R-45HT manufactured by Idemitsu Kosan Co., Ltd.

The epoxy resins having two or more epoxy groups are not existing typical epoxy resins which are hard and brittle but are preferably epoxy resins which are more flexible and tougher than such existing epoxy resins. For example, from the viewpoint of the molecular structure, the epoxy resins preferably have a structure that may increase mobility of the main chain (flexible backbone) in the main chain structure thereof. Examples of the flexible backbone include alkylene backbones, cycloalkane backbones, and polyoxyalkylene backbones. In particular, polyoxyalkylene backbones are suitable.

From the viewpoint of physical properties, suitable are epoxy resins having a low viscosity relative to a molecular weight as compared with existing epoxy resins. Specifically, the weight-average molecular weight is preferably in the range of 900±100, and the viscosity at 25° C. is preferably in the range of 15,000±5,000 mPa·s and more preferably in the range of 15,000±3,000 mPa·s. An example of commercially available products of the epoxy resin having these characteristics is EPICLON EXA-4850-150 manufactured by DIC Corporation.

In the case where the hard segment material and the soft segment material are used, a weight ratio of a material constituting the hard segment to the total weight of the hard segment material and the soft segment material (hereinafter referred to as "hard segment material ratio") is preferably in the range of 10% by weight or more and 30% by weight or less, more preferably in the range of 13% by weight or more and 23% by weight or less, and still more preferably in the range of 15% by weight or more and 20% by weight or less.

When the hard segment material ratio is 10% by weight or more, abrasion resistance is obtained and a good cleaning property is maintained for a long time. When the hard segment material ratio is 30% by weight or less, the resulting material is not excessively hard, flexibility and extensibility are obtained, and the occurrence of chipping is suppressed. Thus, a good cleaning property is maintained for a long time.

Polyisocyanate

Examples of the polyisocyanate used in the synthesis of polyurethane rubber include 4,4'-diphenylmethane diisocyanate (MDI), 2,6-toluene diisocyanate (TDI), hexamethylene diisocyanate (HDI), 1,5-naphthalene diisocyanate (NDI), and 3,3-dimethylphenyl-4,4-diisocyanate (TODI).

From the viewpoint that a hard segment agglomerate having a desired size (particle diameter) is easily formed, 4,4'-diphenylmethane diisocyanate (MDI), 1,5-naphthalene diisocyanate (NDI), and hexamethylene diisocyanate (HDI) are more preferably used as the polyisocyanate.

The amount of polyisocyanate relative to 100 parts by weight of the resin having a functional group that may react with an isocyanate group is preferably 20 parts by weight or more and 40 parts by weight or less, more preferably 20 parts by weight or more and 35 parts by weight or less, and still more preferably 20 parts by weight or more and 30 parts by weight or less.

When the amount of polyisocyanate is 20 parts by weight or more, a large amount of urethane bond is ensured and a hard segment grows. As a result, a desired hardness is obtained. When the amount of polyisocyanate is 40 parts by weight or less, the size of the hard segment does not become excessively large and extensibility is obtained. As a result, the occurrence of chipping of the cleaning blade is suppressed.

Crosslinking Agent

Examples of a crosslinking agent include diols (bifunctional crosslinking agents), triols (trifunctional crosslinking agents), and tetraols (tetrafunctional crosslinking agents). These may be used in combination. Alternatively, amine compounds may be used as the crosslinking agent. The polyurethane rubber may be crosslinked by using a trifunctional or higher crosslinking agent. Examples of the trifunctional crosslinking agent include trimethylolpropane, glycerine, and triisopropanolamine.

The amount of crosslinking agent relative to 100 parts by weight of the resin having a functional group that may react with an isocyanate group is preferably 2 parts by weight or less. When the amount of crosslinking agent is 2 parts by weight or less, the hard segment derived from urethane bonds formed by aging is significantly grown without constraint of molecular motion by chemical crosslinking. Thus, a desired hardness is easily obtained.

Method for Forming Contact Member

A typical method for producing polyurethane, such as a prepolymer method or a one-shot method, is used in the production of polyurethane rubber constituting the contact member in the present exemplary embodiment. The prepolymer method is suitable for the present exemplary embodiment because polyurethane having a high strength and high abrasion resistance is obtained. However, the production method is not limited.

The polyurethane rubber is obtained by mixing an isocyanate compound, a crosslinking agent, etc. with the polyol described above, and forming the resulting mixture. The contact member of the cleaning blade is produced by forming a composition for forming a contact member, the composition being prepared by the above method, into a sheet by using, for example, centrifugal molding or extrusion molding, and performing a cutting process or the like on the resulting sheet.

A method for producing a contact member will be described in detail by using an example.

First, a soft segment material (for example, a polycaprolactone polyol) and a hard segment material (for example, an acrylic resin having two or more hydroxyl groups) are mixed (at a weigh ratio of, for example, 8:2).

Next, an isocyanate compound (for example, 4,4'-diphenylmethane diisocyanate) is added to the mixture of the soft segment material and the hard segment material, and the resulting mixture is allowed to react in, for example, a nitrogen atmosphere. The temperature during this reaction is preferably 60° C. or higher and 150° C. or lower, and more preferably 80° C. or higher and 130° C. or lower. The reaction time is preferably 0.1 hours or more and 3 hours or less, and more preferably 1 hour or more and 2 hours or less.

Subsequently, the isocyanate compound is further added to the reaction mixture, and the resulting mixture is allowed to react in, for example, a nitrogen atmosphere. Thus, a prepolymer is prepared. The temperature during this reaction is preferably 40° C. or higher and 100° C. or lower, and more preferably 60° C. or higher and 90° C. or lower. The reaction time is preferably 30 minutes or more and 6 hours or less, and more preferably 1 hour or more and 4 hours or less.

Subsequently, the temperature of the prepolymer is increased, and the prepolymer is defoamed under a reduced pressure. The temperature at this time is preferably 60° C. or higher and 120° C. or lower, and more preferably 80° C. or higher and 100° C. or lower. The reaction time is preferably 10 minutes or more and 2 hours or less, and more preferably 30 minutes or more and 1 hour or less.

A crosslinking agent (for example, 1,4-butanediol or trimethylolpropane) is then added to the prepolymer to prepare a composition for forming a contact member.

Subsequently, the composition for forming a contact member is poured into a mold of a centrifugal molding machine, and is subjected to a curing reaction. The mold temperature at this time is preferably 80° C. or higher and 160° C. or lower, and more preferably 100° C. or higher and 140° C. or lower. The reaction time is preferably 20 minutes or more and 3 hours or less, and more preferably 30 minutes or more and 2 hour or less.

Furthermore, the resulting cured product is subjected to a crosslinking reaction and cooled. The temperature during heating for aging in this crosslinking reaction is preferably 70° C. or higher and 130° C. or lower, more preferably 80° C. or higher and 130° C. or lower, and still more preferably 100°

C. or higher and 120° C. or lower. The reaction time is preferably 1 hour or more and 48 hours or less, and more preferably 10 hours or more and 24 hours or less.

In the exemplary embodiment, in order to obtain a member that satisfies formulae (1) to (4) above, a post-heating step may be further performed from the viewpoint of controlling agglomeration of the hard segment. By adjusting the heating temperature and the time in the post-heating step, the degree of agglomeration of the hard segment is adjusted and the member is controlled so as to satisfy formulae (1) to (4).

The heating temperature in the post-heating step is preferably 90° C. or higher and 140° C. or lower, more preferably 100° C. or higher and 120° C. or lower, and still more preferably 105° C. or higher and 115° C. or lower. The heating time is preferably 20 minutes or more and 60 minutes or less, more preferably 30 minutes or more and 50 minutes or less, and still more preferably 35 minutes or more and 45 minutes or less.

In the case where the cleaning blade includes only a contact member as illustrated in FIG. 1, the cleaning blade is formed by cutting the resulting product so as to have a predetermined shape before or after the post-heating step.

Tanδ Peak Temperature

A peak temperature of tanδ (loss tangent) in a contact member of a cleaning blade represents a glass transition temperature (Tg).

The tanδ peak temperature of the contact member according to the exemplary embodiment is preferably −30° C. or higher and 5° C. or lower or about −30° C. or higher and about 5° C. or lower, more preferably −25° C. or higher and 2° C. or lower or about −25° C. or higher and about 2° C. or lower, and still more preferably −20° C. or higher and 0° C. or lower or about −20° C. or higher and about 0° C. or lower.

When the tanδ peak temperature is 5° C. or lower or about 5° C. or lower, a contact member having good low-temperature properties and good chipping resistance is obtained. When the tanδ peak temperature is −30° C. or higher or about −30° C. or higher, tanδ at room temperature is not excessively low, and thus a moderate impact resistance is maintained and the contact member does not excessively vibrate.

Herein, the tanδ peak temperature is derived from a storage modulus and a loss modulus described below. In the case where a sine-wave strain is applied to a linear elastic body in a stationary vibration manner, the stress is represented by formula (A). Here, |E*| is referred to as a "complex modulus". On the basis of the theory of rheology, an elastic component is represented by formula (B), and a viscous component is represented by formula (C). Here, E' is referred to as a "storage modulus", and E" is referred to as a "loss modulus". The symbol δ represents a phase difference angle between stress and strain and is referred to as a "mechanical loss angle". The value of tanδ is represented by E"/E' as represented in formula (D), and is referred to as a "loss tangent". The larger the value of tanδ, the higher the rubber elasticity of the linear elastic body.

$$\sigma=|E^*|\gamma\cos(\omega t) \quad \text{Formula (A)}$$

$$E'=|E^*|\cos\delta \quad \text{Formula (B)}$$

$$E''=|E^*|\sin\delta \quad \text{Formula (C)}$$

$$\tan\delta=E''/E' \quad \text{Formula (D)}$$

The value of tanδ is measured by using a Rheospectoler DVE-V4 (manufactured by Rheology Co., Ltd.) at a static strain of 5% with a 10 Hz sine-wave tensile vibration in a temperature range of −60° C. or higher and 100° C. or lower.

The tanδ peak temperature in a contact member is controlled by, for example, the methods described below. For example, in the case where the contact member is composed of polyurethane, the tanδ peak temperature tends to be increased by decreasing the molecular weight of a polyol. In such a case, alternatively, the tanδ peak temperature tends to be increased by increasing the amount of crosslinking agent. However, the method for adjusting the tanδ peak temperature is not limited to these methods.

100% Modulus (Stress at a Given Elongation)

The contact member preferably has a 100% modulus of 6 MPa or more or about 6 MPa or more, more preferably 7 MPa or more or about 7 MPa or more, and still more preferably 7.5 MPa or more or about 7.5 MPa or more. Regarding the upper limit of the 100% modulus, the 100% modulus is preferably 11 MPa or less, and more preferably 10 MPa or less.

When the 100% modulus is 6 MPa or more or about 6 MPa or more, an appropriate hardness is obtained and thus the contact member has good abrasion resistance.

Herein, the 100% modulus is measured in accordance with JIS K6251 (2004). Specifically, the measurement is performed by using a dumbbell-shaped No. 3 test piece at a tensile speed of 500 mm/min to obtain a stress-strain curve (environment temperature: 23° C.), and the 100% modulus is determined from the curve. A Strograph AE Elastomer manufactured by Toyo Seiki Seisaku-sho, Ltd. is used as a measurement device.

(Non-Contact Member)

A description will now be made of a composition of a non-contact member in the case where the cleaning blade of the exemplary embodiment has a structure in which a contact member and a region other than the contact member (non-contact member) are composed of different materials, as in the second exemplary embodiment illustrated in FIG. 5 or the third exemplary embodiment illustrated in FIG. 6.

The non-contact member in the cleaning blade according to the exemplary embodiment is not particularly limited, and any known material may be used as the non-contact member.

Examples of the material used as the non-contact member include polyurethane rubber, silicone rubber, fluororubber, chloroprene rubber, and butadiene rubber. Among these materials, polyurethane rubber is preferable. Examples of the polyurethane rubber include ester-based polyurethanes and ether-based polyurethanes. In particular, ester-based polyurethanes are preferable.

An example of a method for producing polyurethane rubber is a method using a polyol and a polyisocyanate.

Examples of the polyol include polytetramethylene ether glycol, polyethylene adipate, and polycaprolactone.

Examples of the polyisocyanate include 2,6-toluene diisocyanate (TDI), 4,4'-diphenylmethane diisocyanate (MDI), para-phenylene diisocyanate (PPDI), 1,5-naphthalene diisocyanate (NDI), and 3,3-dimethylphenyl-4,4-diisocyanate (TODI). Among these polyisocyanates, MDI is preferable.

Furthermore, examples of a curing agent for curing a polyurethane include 1,4-butanediol, trimethylolpropane, ethylene glycol, and mixtures thereof.

A specific example will be described. 4,4'-Diphenylmethane diisocyanate is mixed with polytetramethylene ether glycol which has been subjected to a dehydration treatment, and the resulting mixture is allowed to react to produce a prepolymer. 1,4-Butanediol and trimethylolpropane are used in combination as a curing agent, and added to the prepolymer. An additive such as a reaction-controlling agent may be added thereto.

A known method is used as a method for preparing the non-contact member in accordance with a raw material used in the preparation. For example, the non-contact member is produced by forming the material by centrifugal molding or extrusion molding, and performing a cutting process or the like on the resulting formed product so as to have a predetermined shape.

(Production of Cleaning Blade)

In the case where a cleaning blade includes only a contact member illustrated in FIG. 1, the cleaning blade is produced by the above-described method for forming the contact member.

In the case where a cleaning blade has a multilayer structure, for example, the two-layer structure illustrated in FIG. 5, the cleaning blade is produced by bonding a first layer functioning as a contact member and a second layer (plural layers in the case of a structure including three or more layers) functioning as a non-contact member to each other. In the method for bonding the layers to each other, a double-sided tape, an adhesive, or the like is suitably used. Alternatively, plural layers may be bonded to each other by pouring materials of respective layers into a mold at time intervals in a step of molding, thus joining the molded materials to each other without providing an adhesive layer.

In the case where a cleaning blade includes a contact member (edge member) and a non-contact member (back surface member) as illustrated in FIG. 6, the cleaning blade is produced as follows. A first mold and a second mold are prepared. The first mold has a cavity (region into which a composition for forming a contact member is poured) corresponding to a semicircular column shape formed by arranging two contact members 3421C illustrated in FIG. 6 so that the front surfaces 3C of the members 3421C contact each other. The second mold has a cavity corresponding to a shape formed by arranging two contact members 3421C and two non-contact members 3422C so that the front surfaces 3C of the members 3421C and 3422C contact each other. A composition for forming a contact member is poured into the cavity of the first mold and then cured to form a first molded body having a shape in which the two contact members 3421C contact each other. Next, the first mold is detached. Subsequently, the second mold is disposed so that the first molded body is arranged inside the cavity of the second mold. A composition for forming a non-contact member is then poured into the cavity of the second mold so as to cover the first molded body and cured to form a second molded body having a shape in which the two contact members 3421C and the two non-contact members 3422C are arranged so that the front surfaces 3C of the members 3421C and 3422C contact each other. Subsequently, the resulting second molded body is cut at the center, that is, at a portion which is to become the front surface 3C. Specifically, the second molded body is cut such that the contact member having a semicircular column shape is separated at the center and each of the separated molded bodies has a shape of a quarter-circle column. The resulting molded body is further cut so as to have a predetermined dimension. Thus, the cleaning blade illustrated in FIG. 6 is produced.

Applications

In the case where a member to be cleaned is cleaned by using the cleaning blade of the exemplary embodiment, the member to be cleaned, which is a target of cleaning, is not particularly limited as long as cleaning of a surface of the member is required. For example, in the case where the cleaning blade is used in an image forming apparatus, examples of the member to be cleaned include an intermediate transfer body, a charging roller, a transfer roller, a transfer material-transporting belt, a paper transport roller, and a detoning roller that further removes a toner from a cleaning brush for removing the toner from an image carrying member. In the exemplary embodiment, the member to be cleaned may be an image carrying member.

(Cleaning Device, Process Cartridge, and Image Forming Apparatus)

A cleaning device, a process cartridge, and an image forming apparatus that include the cleaning blade of the present exemplary embodiment will be described.

The cleaning device of the exemplary embodiment is not particularly limited as long as the cleaning blade of the exemplary embodiment is provided as a cleaning blade that comes in contact with a surface of a member to be cleaned and that cleans the surface of the member. An example of the structure of the cleaning device is as follows. In a cleaning case having an opening adjacent to a member to be cleaned, a cleaning blade is fixed so that an end of an edge thereof is located on the opening side. The cleaning device includes a transport member that leads foreign matter such as a waste toner and the like to a foreign matter-collecting container, the waste toner and the like being collected by the cleaning blade from a surface of the member to be cleaned. The cleaning device of the exemplary embodiment may include two or more cleaning blades of the exemplary embodiment.

In the case where the cleaning blade of the exemplary embodiment is used for cleaning an image carrying member, in order to suppress image deletion during image formation, a force NF (normal force) at which the cleaning blade is pressed onto the image carrying member is preferably in the range of 1.3 gf/mm or more and 2.3 gf/mm or less, and more preferably in the range of 1.6 gf/mm or more and 2.0 gf/mm or less.

A length of an end of the cleaning blade engaged in the image carrying member is preferably in the range of 0.8 mm or more and 1.2 mm or less, and more preferably in the range of 0.9 mm or more and 1.1 mm or less.

An angle W/A (working angle) in the portion at which the cleaning blade comes in contact with the image carrying member is preferably in the range of 8° or more and 14° or less, and more preferably in the range of 10° or more and 12° or less.

The process cartridge of the exemplary embodiment is not particularly limited as long as the process cartridge includes the cleaning device of the exemplary embodiment as a cleaning device that comes in contact with a surface of at least one member to be cleaned, such as an image carrying member and an intermediate transfer body, and that cleans the surface of the at least one member to be cleaned. For example, an exemplary embodiment of the process cartridge is detachably provided in an image forming apparatus and includes an image carrying member and the cleaning device of the exemplary embodiment that cleans the surface of the image carrying member. For example, in the case of a so-called tandem machine that includes image carrying members corresponding to toners of respective colors, the cleaning device of the exemplary embodiment may be provided for each of the image carrying members. Besides the cleaning device of the exemplary embodiment, a cleaning brush and the like may be used in combination.

—Specific Examples of Cleaning Blade, Image Forming Apparatus, and Cleaning Device—

Specific examples of the cleaning blade of the present exemplary embodiment, and an image forming apparatus and a cleaning device that include the cleaning blade will now be described in more detail with reference to the drawings.

Figure 3:
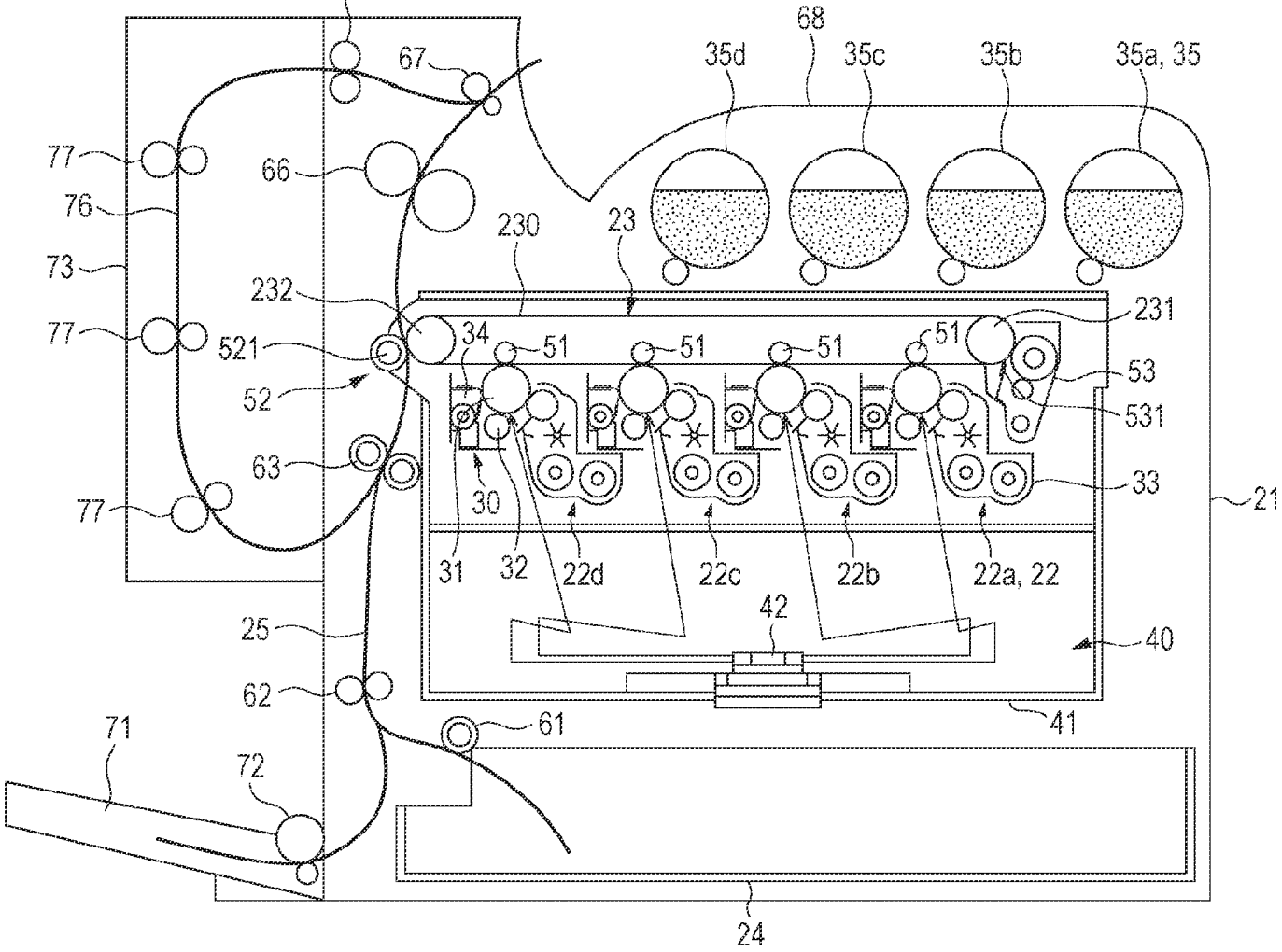
FIG. 3 is a schematic outline view illustrating an example of an image forming apparatus according to an exemplary embodiment.

FIG. 3 is an outline schematic view illustrating an example of an image forming apparatus according to the exemplary embodiment and illustrates a so-called tandem image forming apparatus.

The image forming apparatus illustrated in FIG. 3 includes a body housing 21, image forming units 22 (22*a* to 22*d*), a belt module 23, a recording medium supply cassette 24, a recording medium transport path 25, photoreceptor units 30, photoreceptor drums 31, charging rollers 32, developing units 33, cleaning devices 34, toner cartridges 35 (35*a* to 35*d*), an exposure unit 40, a unit case 41, a polygon mirror 42, first transfer devices 51, a second transfer device 52, a belt cleaning device 53, a feed roller 61, transport rollers 62, positioning rollers 63, a fixing device 66, discharge rollers 67, a paper discharge unit 68, a manual feeder 71, feed rollers 72, a double-side recording unit 73, guide rollers 74, a transport path 76, transport rollers 77, an intermediate transfer belt 230, support rollers 231 and 232, a second transfer roller 521, and a cleaning blade 531.

In the tandem image forming apparatus illustrated in FIG. 3, the image forming units 22 (specifically, 22*a* to 22*d*) of four colors (yellow, magenta, cyan, and black in the exemplary embodiment) are arranged in the body housing 21. Above the image forming units 22, the belt module 23 is arranged. The belt module 23 includes the intermediate transfer belt 230 which is transported in a circulating manner along a direction in which the image forming units 22 are arranged. In a lower portion of the body housing 21, the recording medium supply cassette 24 in which a recording medium (not shown) such as paper is housed is arranged, and the recording medium transport path 25, which serves as a transport path of the recording medium from the recording medium supply cassette 24, is arranged in the vertical direction.

In the exemplary embodiment, the image forming units 22 (22*a* to 22*d*) sequentially form toner images for yellow, magenta, cyan, and black (the arrangement of the image forming units 22 is not particularly limited to this order) from the upstream in a circulation direction of the intermediate transfer belt 230. The image forming units 22 (22*a* to 22*d*) each include a photoreceptor unit 30, a developing unit 33, and a common expose unit 40.

Each of the photoreceptor units 30 is produced by, for example, integrally arranging, as a sub-cartridge, a photoreceptor drum 31, a charging device (charging roller) 32 that charges the photoreceptor drum 31 in advance, and a cleaning device 34 that removes a remaining toner on the photoreceptor drum 31.

Each of the developing units 33 develops an electrostatic latent image, which is formed on the charged photoreceptor drum 31 by exposure with the exposure unit 40, with a corresponding color toner (for example, negative polarity in the exemplary embodiment). For example, each of the developing units 33 is integrated with the sub-cartridge formed by the photoreceptor unit 30 to form a process cartridge (so-called customer replaceable unit).

The photoreceptor unit 30 may be separated from the developing unit 33 and used alone as a process cartridge. In FIG. 3, the toner cartridges 35 (35*a* to 35*d*) supply respective color component toners to the corresponding developing units 33 (toner supply paths are not shown in the figure).

The exposure unit 40 includes, for example, four semiconductor lasers (not shown), the polygon mirror 42, imaging lenses (not shown), and mirrors (not shown) corresponding to the photoreceptor units 30 in the unit case 41. The exposure unit 40 is configured to deflect and scan light from the semiconductor laser for each color component by the polygon mirror 42, and to guide an optical image to an exposure point on the corresponding photoreceptor drum 31 through the imaging lens and the mirror.

In the exemplary embodiment, the belt module 23 includes, for example, a pair of the support rollers (one of which functions as a driving roller) 231 and 232, and the intermediate transfer belt 230 that is stretched between the support rollers 231 and 232. The first transfer devices (first transfer rollers in this exemplary embodiment) 51 are arranged at positions on the back surface of the intermediate transfer belt 230, the positions corresponding to the photoreceptor drums 31 of the respective photoreceptor units 30. By applying a voltage having a polarity opposite to the charging polarity of a toner to each of the first transfer devices 51, the toner image on the photoreceptor drum 31 is electrostatically transferred to the intermediate transfer belt 230. Furthermore, the second transfer device 52 is arranged in a portion corresponding to the support roller 232 on the downstream of the image forming unit 22*d* which is arranged on the most downstream side of the intermediate transfer belt 230. The second transfer device 52 performs a second transfer (collective transfer) of first transfer images formed on the intermediate transfer belt 230 to a recording medium.

In the exemplary embodiment, the second transfer device 52 includes the second transfer roller 521 which is disposed on the toner image carrying surface side of the intermediate transfer belt 230 under pressure, and a back surface roller (also used as the support roller 232 in this exemplary embodiment) which is disposed on the back surface side of the intermediate transfer belt 230 and which functions as a counter electrode of the second transfer roller 521. For example, the second transfer roller 521 is grounded, and a bias having the same polarity as the charging polarity of the toner is applied to the back surface roller (support roller 232).

The belt cleaning device 53 is arranged on the upstream of the image forming unit 22*a* which is disposed on the most upstream side of the intermediate transfer belt 230. The belt cleaning device 53 removes the remaining toner on the intermediate transfer belt 230.

The feed roller 61 which feeds a recording medium is disposed on the recording medium supply cassette 24. The transport rollers 62 which feed the recording medium are arranged right behind the feed roller 61. The positioning rollers 63 which supply the recording medium to a second transfer portion at a predetermined timing are arranged on the recording medium transport path 25 which is located right in front of the second transfer portion. The fixing device 66 is arranged on the recording medium transport path 25 located on the downstream of the second transfer portion. The discharge rollers 67 for discharging the recording medium are arranged on the downstream of the fixing device 66. The discharged recording medium is housed in the paper discharge unit 68 formed in an upper portion of the body housing 21.

In the exemplary embodiment, the manual feeder (multi sheet inserter (MSI)) 71 is arranged on a side of the body housing 21. A recording medium on the manual feeder 71 is fed toward the recording medium transport path 25 through the feed rollers 72 and the transport rollers 62.

The double-side recording unit 73 is attached to the body housing 21. When a double-side mode, in which image recording is performed on two surfaces of a recording medium, is selected, the double-side recording unit 73 operates as follows. A recording medium in which recording has been performed on one surface thereof is reversed by reversely rotating the discharge roller 67, and introduced into the inner portion through the guide rollers 74 arranged in front of an inlet. The recording medium in the inner portion is transported through the transporting rollers 77 and along the transport path 76 for returning the recording medium, and supplied again to the positioning roller 63 side.

Next, the cleaning device 34 arranged in the tandem image forming apparatus illustrated in FIG. 3 will be described in detail.

Figure 4:
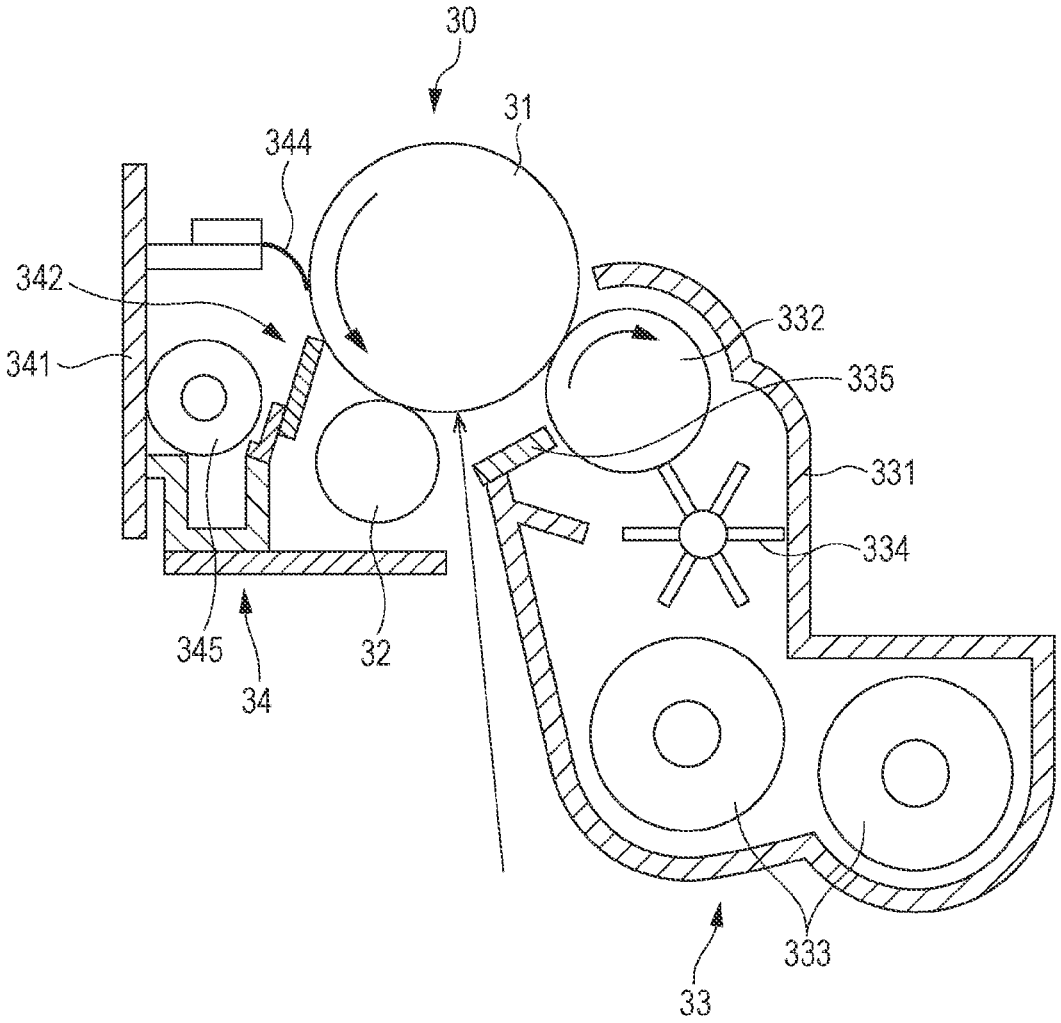
FIG. 4 is a schematic cross-sectional view illustrating an example of a cleaning device according to an exemplary embodiment.

FIG. 4 is a schematic cross-sectional view illustrating an example of the cleaning device of the exemplary embodiment. FIG. 4 also illustrates the photoreceptor drum 31 and the charging roller (charging device) 32 that form a sub-cartridge together with the cleaning device 34 illustrated in FIG. 3, and the developing unit 33.

In FIG. 4, the developing unit 33 includes a unit case 331, a developing roller 332, toner-transporting members 333, a transport paddle 334, and a developer quantity regulating member 335. The cleaning device 34 includes a cleaning case 341, a cleaning blade 342, a film seal 344, and a transport member 345.

The cleaning case 341 of the cleaning device 34 stores a remaining toner and is opened so as to face the photoreceptor drum 31. The cleaning blade 342 that is disposed to be in contact with the photoreceptor drum 31 is attached to a lower edge of the opening of the cleaning case 341 with a bracket (not shown) therebetween. The film seal 344 that keeps air-tightness between the cleaning case 341 and the photoreceptor drum 31 is attached to an upper edge of the opening of the cleaning case 341. The transport member 345 guides a waste toner stored in the cleaning case 341 to a waste toner container provided on a side face.

In the exemplary embodiment, in all the cleaning devices 34 of respective image forming units 22 (22*a* to 22*d*), the cleaning blade of the exemplary embodiment may be used as the cleaning blade 342. In addition, the cleaning blade of the exemplary embodiment may be used as the cleaning blade 531 in the belt cleaning device 53.

As illustrated in FIG. 4, for example, the developing unit (developing device) 33 used in the exemplary embodiment includes the unit case 331 that stores a developer and is opened so as to face the photoreceptor drum 31. The developing roller 332 is arranged at a position facing the opening of the unit case 331. The toner-transporting members 333 for stirring and transporting the developer are arranged in the unit case 331. Furthermore, the transport paddle 334 may be arranged between the developing roller 332 and the toner-transporting members 333.

In the developing, after the developer is supplied to the developing roller 332, the developer is transported to a developing area facing the photoreceptor drum 31 in a state where, for example, a layer thickness of the developer is regulated with the developer quantity regulating member 335.

In the exemplary embodiment, for example, a two-component developer containing a toner and a carrier is used in the developing unit 33. Alternatively, a one-component developer containing only a toner may be used.

Next, the operation of the image forming apparatus according to the present exemplary embodiment will be described. First, the respective image forming units 22 (22*a* to 22*d*) form single-color toner images corresponding to each color. The single-color toner images of each color are sequentially superimposed so as to match with original document information and subjected to a first transfer to a surface of the intermediate transfer belt 230. Subsequently, the color toner images transferred to the surface of the intermediate transfer belt 230 are transferred to a surface of a recording medium by the second transfer device 52. The recording medium to which the color toner images have been transferred is subjected to a fixing treatment by the fixing device 66, and then discharged to the paper discharge unit 68.

In the respective image forming units 22 (22*a* to 22*d*), the remaining toner on the photoreceptor drum 31 is cleaned by the cleaning device 34, and the remaining toner on the intermediate transfer belt 230 is cleaned by the belt cleaning device 53.

In this image forming process, each remaining toner is cleaned by the cleaning device 34 (or the belt cleaning device 53).

In the exemplary embodiment, the cleaning blade 342 is directly fixed to a frame member in the cleaning device 34 as illustrated in FIG. 4. Alternatively, the cleaning blade 342 may be fixed to a frame member with a spring material therebetween.

EXAMPLES

The invention will now be described using Examples. However, the invention is not limited to the Examples. In the description below, the term "part" means "part by weight".

Example 1

—Preparation of Cleaning Blade Body—

A polycaprolactone polyol (PLACCEL 205, manufactured by Daicel Corporation, average molecular weight: 529, hydroxyl value: 212 KOHmg/g) and a polycaprolactone polyol (PLACCEL 240, manufactured by Daicel Corporation, average molecular weight: 4,155, hydroxyl value: 27 KOHmg/g) are used as a soft segment material of a polyol component. An acrylic resin having two or more hydroxyl groups (ACTFLOW UMB-2005B, manufactured by Soken Chemical & Engineering Co., Ltd.) is used as a hard segment material. The soft segment material and the hard segment material are mixed at a ratio of 8:2 (weight ratio).

Next, 6.26 parts of 4,4'-diphenylmethane diisocyanate (MILLIONATE MT, manufactured by Nippon Polyurethane Industry Co., Ltd.) is added as an isocyanate compound relative to 100 parts of the mixture of the soft segment material and the hard segment material. The resulting mixture is allowed to react in a nitrogen atmosphere at 70° C. for three hours. The amount of isocyanate compound used in this reaction is selected so that a ratio (isocyanate group/hydroxyl group) of the isocyanate group to the hydroxyl group included in the reaction system becomes 0.5.

Subsequently, 34.3 parts of the isocyanate compound is further added thereto, and the resulting mixture is allowed to react in a nitrogen atmosphere at 70° C. for three hours. Thus, a prepolymer is obtained. The total amount of isocyanate compound used in the preparation of the prepolymer is 40.56 parts.

Next, the temperature of the prepolymer is increased to 100° C., and the prepolymer is defoamed under a reduced pressure for one hour. Subsequently, 7.14 parts of a mixture of 1,4-butanediol and trimethylolpropane (weight ratio=60/40) is added relative to 100 parts of the prepolymer and mixed for three minutes so that foaming does not occur. Thus, a composition A for forming a blade is prepared.

Next, the composition A for forming a blade is poured into a centrifugal molding machine including a mold whose temperature is adjusted to 140° C., and subjected to a curing reaction for one hour. Subsequently, the composition A is aged by heating at 110° C. for 24 hours, and then cooled.

Subsequently, a post-heating step is further performed. The heating temperature is 100° C. and the heating time is 30 minutes. The resulting composition A is then cut to prepare a cleaning blade having a length of 320 mm, a width of 12 mm, and a thickness of 2 mm.

Measurement of Physical Property Values

Thermal analysis of the cleaning blade prepared as described above is performed with a differential scanning calorimeter to measure a heat of crystal fusion ΔH1 (mJ/mg) in a crystal fusion peak 1 in the range of 70° C. or higher and lower than 110° C. or in the range of about 70° C. or higher and lower than about 110° C., a heat of crystal fusion ΔH2 (mJ/mg) in a crystal fusion peak 2 in the range of 110° C. or higher and lower than 170° C. or in the range of about 110° C. or higher and lower than about 170° C., and a heat of crystal fusion ΔH3 (mJ/mg) in a crystal fusion peak 3 in the range of 170° C. or higher and 200° C. or lower or in the range of about 170° C. or higher and about 200° C. or lower.

A tanδ peak temperature and a 100% modulus (stress at a given elongation) are measured by the methods described above.

These results are shown in Table 3 below.

Examples 2 to 10 and Comparative Examples 1 to 5

Cleaning blades are prepared as in Example 1 except that the temperature and the time in the post-heating step are changed as shown in Tables 3 and 4 below.

<Evaluation Test>

—Edge Abrasion—

Edge abrasion is evaluated as follows. An image is formed on A4 sheets (210×297 mm, P paper, manufactured by Fuji Xerox Co., Ltd.) in a high-temperature high-humidity environment (28° C., 85 RH %) using an image forming apparatus (trade name: DocuCentre-IIC7500, manufactured by Fuji Xerox Co., Ltd.) until the cumulative number of rotations of a photoreceptor becomes 100K cycles. After the image formation, abrasion of an edge portion (contact angle portion) of a cleaning blade and defective cleaning are evaluated.

In this test, in order to perform the evaluation under a severe condition in which the lubricating effect in a portion at which the photoreceptor comes in contact with the cleaning blade is reduced, an image density of the image to be formed is set to 1%.

Subsequently, an abrasion depth of the edge portion (contact angle portion) after the test is determined from the maximum depth of an edge-missing portion on the photoreceptor surface side of the cleaning blade by observing the cleaning blade from the cross-section side thereof with a laser microscope VK-8510 manufactured by Keyence Corporation.

The defective cleaning is evaluated as follows. After the completion of the above test, an A3 sheet on which an untransferred solid image (solid image size: 400 mm×290 mm) is formed is supplied between the photoreceptor and the cleaning blade. The apparatus is stopped immediately after the last end portion of the unfixed image in the transporting direction passes a portion at which the photoreceptor comes in contact with the cleaning blade, and slipping through of the toner is visually observed. When slipping through of the toner is observed, it is determined that defective cleaning occurs.

In the case where a portion for holding the toner is lost by abrasion or chipping of the edge portion (contact angle portion), the larger the abrasion depth or the chipping depth of the edge, the more easily defective cleaning occurs in the test described above. Accordingly, the above test is useful for a qualitative evaluation of abrasion or chipping of the edge portion (contact angle portion).

TABLE 1

| Edge abrasion evaluation criteria | Edge abrasion depth | Defective cleaning |
|---|---|---|
| C0 | 3 μm or less<br>Abrasion trace is not observed. | Not occur |
| C1 | 3 μm or less | Not occur |
| C2 | More than 3 μm and 5 μm or less | Not occur |
| C3 | More than 3 μm and 5 μm or less | Occur |
| C4 | More than 5 μm and 10 μm or less | Occur |
| C5 | More than 10 μm | Occur |

—Chipping—

The degree of the occurrence of chipping is evaluated by the following method. A cleaning blade is mounted on DocuCentre-IV C5575 manufactured by Fuji Xerox Co., Ltd., a normal force (NF) is adjusted to 1.3 gf/mm, and a working angle (W/A) is adjusted to 11°. Subsequently, 10 k sheets are printed.

The degree of the occurrence of chipping is evaluated in accordance with criteria described below on the basis of the size and the number of chippings generated at that time. The degree of the occurrence of chipping is measured in a range of 100 mm of a central portion in the axial direction.

TABLE 2

| Edge chipping evaluation criteria | Edge abrasion depth | Defective cleaning |
|---|---|---|
| C1 | Chipping does not occur | Not occur |
| C2 | Chipping size: 1 μm or less<br>Number of chippings: 1 or more and less than 5 | Not occur |
| C3 | Chipping size: 1 μm or less<br>Number of chippings: 5 or more and less than 10 | Not occur |
| C4 | Chipping size: 1 μm or less<br>Number of chippings: 10 or more | Not occur |
| C5 | Chipping size: more than 1 μm and 5 μm or less<br>Number of chippings: 1 or more and less than 5 | Not occur |
| C6 | Chipping size: more than 1 μm and 5 μm or less<br>Number of chippings: 5 or more and less than 10 | Occur |
| C7 | Chipping size: more than 1 μm and 5 μm or less<br>Number of chippings: 10 or more | Occur |
| C8 | Chipping size: more than 5 μm<br>Number of chippings: 1 or more and less than 5 | Occur |
| C9 | Chipping size: more than 5 μm<br>Number of chippings: 5 or more and less than 10 | Occur |
| C10 | Chipping size: more than 5 μm<br>Number of chippings: 10 or more | Occur |

—Comprehensive Evaluation—

A comprehensive evaluation is performed on the basis of the following criteria.

A: The result of the edge abrasion evaluation is C0 or C1 and the result of the chipping evaluation is C1 or C2.

B: The result of the edge abrasion evaluation is C2 or the result of the chipping evaluation is any one of C3 to C5 (however, this case does not correspond to C below).

C: The result of the edge abrasion evaluation is any one of C3 to C5 or the result of the chipping evaluation is any one of C6 to C10.

TABLE 3

| | | Example | | | | | | | | | |
|---|---|---|---|---|---|---|---|---|---|---|---|
| | | 1 | 2 | 3 | 4 | 5 | 6 | 7 | 8 | 9 | 10 |
| Post-heating step | Temperature (° C.) | 100 | 108 | 116 | 104 | 95 | 110 | 110 | 122 | 134 | 136 |
| | Time (min) | 30 | 45 | 40 | 50 | 30 | 40 | 35 | 50 | 45 | 30 |
| ΔH1 (mJ/mg) | | 0.1 | 0.1 | 1 | 5 | 2 | 2 | 2 | 2 | 5 | 1 |
| ΔH2 (mJ/mg) | | 0.1 | 3 | 3 | 3 | 0.1 | 5 | 3 | 3 | 5 | 1.1 |
| ΔH3 (mJ/mg) | | 0 | 0.5 | 0.5 | 0.5 | 0.5 | 0.5 | 0 | 2 | 2 | 2 |
| ΔH1 + ΔH2 > ΔH3 | | Satisfied | Satisfied | Satisfied | Satisfied | Satisfied | Satisfied | Satisfied | Satisfied | Satisfied | Satisfied |
| tanδ peak temperature (° C.) | | −10 | −8 | −7 | −8 | 1 | −12 | −30 | 5 | −8 | 4 |
| 100% modulus (MPa) | | 6.6 | 6.7 | 6.7 | 7.1 | 6.5 | 6.8 | 6 | 8 | 6.9 | 7.2 |
| Edge abrasion | | C2 | C1 | C1 | C0 | C1 | C0 | C2 | C0 | C0 | C0 |
| Edge chipping | | C1 | C1 | C1 | C1 | C3 | C1 | C1 | C3 | C1 | C3 |
| Comprehensive evaluation | | B | A | A | A | B | A | B | B | A | B |

TABLE 4

| | | Comparative Example | | | | |
|---|---|---|---|---|---|---|
| | | 1 | 2 | 3 | 4 | 5 |
| Post-heating step | Temperature (° C.) | 150 | 160 | 150 | 80 | 150 |
| | Time (min) | 35 | 20 | 15 | 60 | 60 |
| ΔH1 (mJ/mg) | | 1.5 | 0.1 | 0.3 | 6 | 2 |
| ΔH2 (mJ/mg) | | 1 | 1 | 1.2 | 2 | 4 |
| ΔH3 (mJ/mg) | | 3 | 2 | 1.7 | 2 | 4 |
| ΔH1 + ΔH2 > ΔH3 | | Not Satisfied | Not Satisfied | Not Satisfied | Satisfied | Satisfied |
| tanδ peak temperature (° C.) | | 7 | 6 | 7 | 7 | 6 |
| 100% modulus (MPa) | | 7.6 | 7.2 | 7.5 | 5.5 | 7 |
| Edge abrasion | | C0 | C0 | C0 | C4 | C0 |
| Edge chipping | | C10 | C8 | C9 | C7 | C10 |
| Comprehensive evaluation | | C | C | C | C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising:

a member in which, in thermal analysis with a differential scanning calorimeter, a heat of crystal fusion ΔH1 (mJ/mg) in a crystal fusion peak 1 in a range of 70° C. or higher and lower than 110° C., a heat of crystal fusion ΔH2 (mJ/mg) in a crystal fusion peak 2 in a range of 110° C. or higher and lower than 170° C., and a heat of crystal fusion ΔH3 (mJ/mg) in a crystal fusion peak 3 in a range of 170° C. or higher and 200° C. or lower satisfy formulae (1) to (4), the member constituting at least a contact portion that comes in contact with a member to be cleaned $$\Delta H1+\Delta H2>\Delta H3 \quad \text{Formula (1)}$$

$$0.0\leq\Delta H1\leq5.0 \quad \text{Formula (2)}$$

$$0.1\leq\Delta H2 \quad \text{Formula (3)}$$

$$0.0\leq\Delta H3\leq2.0 \quad \text{Formula (4).}$$

2. The cleaning blade according to claim 1, wherein the heat of crystal fusion ΔH1 (mJ/mg) satisfies formula (2')

$$1.0\leq\Delta H1\leq3.0 \quad \text{Formula (2').}$$

3. The cleaning blade according to claim 1, wherein the heat of crystal fusion ΔH2 (mJ/mg) satisfies formula (3')

$$3.0\leq\Delta H2\leq5.0 \quad \text{Formula (3').}$$

4. The cleaning blade according to claim 1, wherein the heat of crystal fusion ΔH3 (mJ/mg) satisfies formula (4')

$$0.0\leq\Delta H3\leq0.5 \quad \text{Formula (4').}$$

5. The cleaning blade according to claim 1, wherein the member constituting the contact portion is an elastic member having a tanδ peak temperature of −30° C. or higher and 5° C. or lower.

6. The cleaning blade according to claim 1, wherein the member constituting the contact portion is an elastic member having a tanδ peak temperature of −25° C. or higher and 2° C. or lower.

7. The cleaning blade according to claim 1, wherein the member constituting the contact portion is an elastic member having a tanδ peak temperature of−20° C. or higher and 0° C. or lower.

8. The cleaning blade according to claim 1, wherein the member constituting the contact portion is an elastic member having a 100% modulus of 6 MPa or more.

9. The cleaning blade according to claim 1, wherein the member constituting the contact portion is an elastic member having a 100% modulus of 7.5 MPa or more.

10. A process cartridge detachably provided in an image forming apparatus, the process cartridge comprising a cleaning device including the cleaning blade according to claim 1.

11. An image forming apparatus comprising:

an image carrying member;

a charging device that charges the image carrying member;

an electrostatic latent image forming device that forms an electrostatic latent image on a surface of the charged image carrying member;

a developing device that develops the electrostatic latent image formed on the surface of the image carrying member by using a toner to form a toner image;

a transfer device that transfers the toner image formed on the image carrying member onto a recording medium; and a cleaning device that includes the cleaning blade according to claim 1 and that conducts cleaning by bringing the cleaning blade into contact with the surface of the image carrying member after the toner image is transferred by the transfer device.

* * * * *